US007695336B2

(12) United States Patent
Stanic et al.

(10) Patent No.: US 7,695,336 B2
(45) Date of Patent: Apr. 13, 2010

(54) DEVICE FOR INTRODUCING AN ACCURATELY DOSABLE AMOUNT OF MERCURY.

(75) Inventors: Petar Stanic, Herzogenaurach (DE); Jürgen Remde, Nürnberg (DE)

(73) Assignee: Flowil International Lighting (Holding) B.V., Amsterdam (NL)

( * ) Notice: Subject to any disclaimer, the term of this patent is extended or adjusted under 35 U.S.C. 154(b) by 433 days.

(21) Appl. No.: 11/783,194

(22) Filed: Apr. 6, 2007

(65) Prior Publication Data

US 2007/0281572 A1 Dec. 6, 2007

(30) Foreign Application Priority Data

Apr. 7, 2006 (EP) ..... 06007445

(51) Int. Cl.
*H01J 9/395* (2006.01)

(52) U.S. Cl. ..... 445/16

(58) Field of Classification Search ..... 445/9–16, 445/24–26; 313/582

See application file for complete search history.

(56) References Cited

U.S. PATENT DOCUMENTS

| | | | |
|---|---|---|---|
| 2,391,573 | A | 12/1945 | Herzog |
| 2,433,177 | A | 12/1947 | Wainio |
| 2,699,279 | A | 1/1955 | Dodge et al. |
| 2,726,799 | A | 12/1955 | Dodge et al. |
| 2,842,290 | A | 7/1958 | Dodge et al. |

FOREIGN PATENT DOCUMENTS

| | | |
|---|---|---|
| JP | 55043729 | 3/1980 |
| JP | 55093635 | 7/1980 |
| WO | WO 97/19461 | 5/1997 |

*Primary Examiner*—Joseph L Williams
*Assistant Examiner*—Brenitra M Lee
(74) *Attorney, Agent, or Firm*—Jean C. Edwards, Esq.; Akerman Senterfitt

(57) ABSTRACT

A method is proposed for introducing an accurately dosable amount of mercury into the discharge vessel of a lamp, in particular into a straight fluorescent lamp, wherein both sides of the discharge vessel are connected to a lamp receptacle; and the discharge vessel is charged with a gas stream via the lamp receptacle and is filled, moreover, with a predetermined amount of mercury via a mercury introducing channel. Furthermore, it is provided that during or after dosing the amount of mercury to be introduced, the mercury is brought in a dosed volume in the form of a single, coalescing drop, and then in a fill step the entire amount of mercury to be introduced is transported into the discharge vessel, while still maintaining the previously formed drop. To this end, there is a change-over mechanism, which in the preparation step guides the gas stream past the drop via a bypass channel and in a fill step blocks the bypass channel in such a manner that, while the bypass channel is blocked, the gas stream is guided over the dosed volume and drags the drop along with it into the discharge vessel.

19 Claims, 13 Drawing Sheets

X

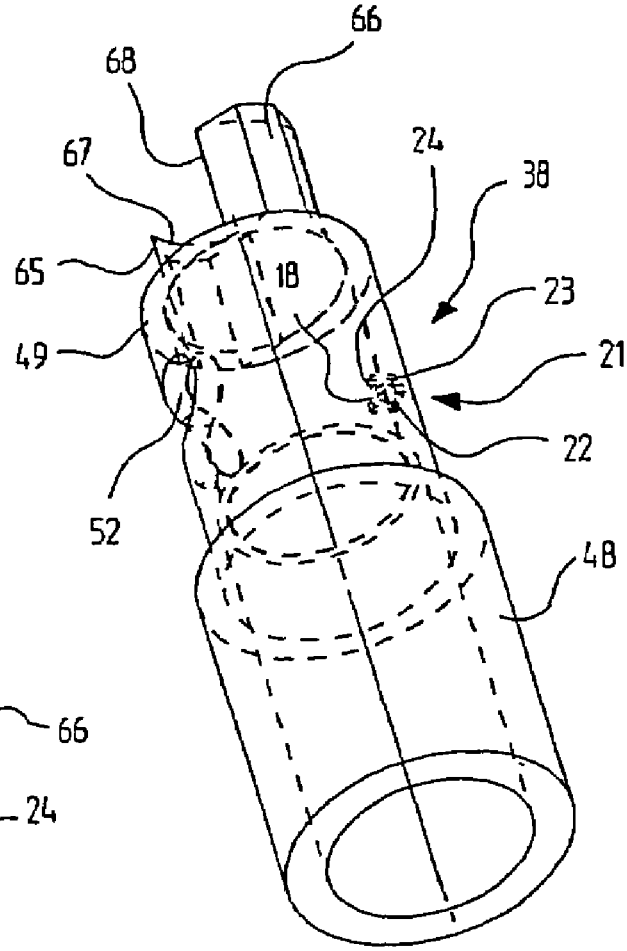
FIG 10
FIG 11
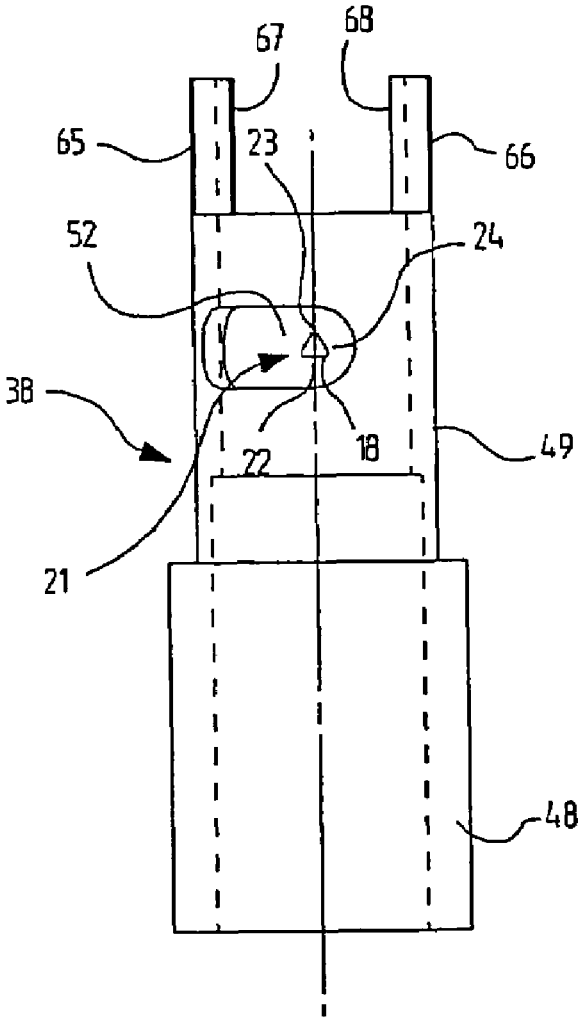

FIG 12
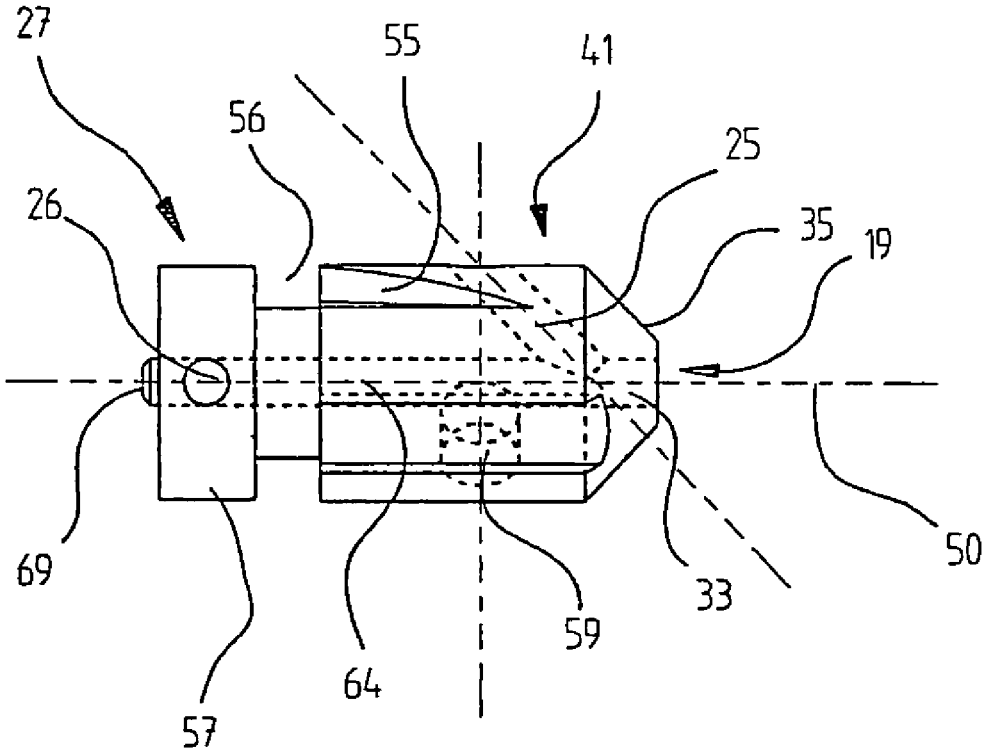
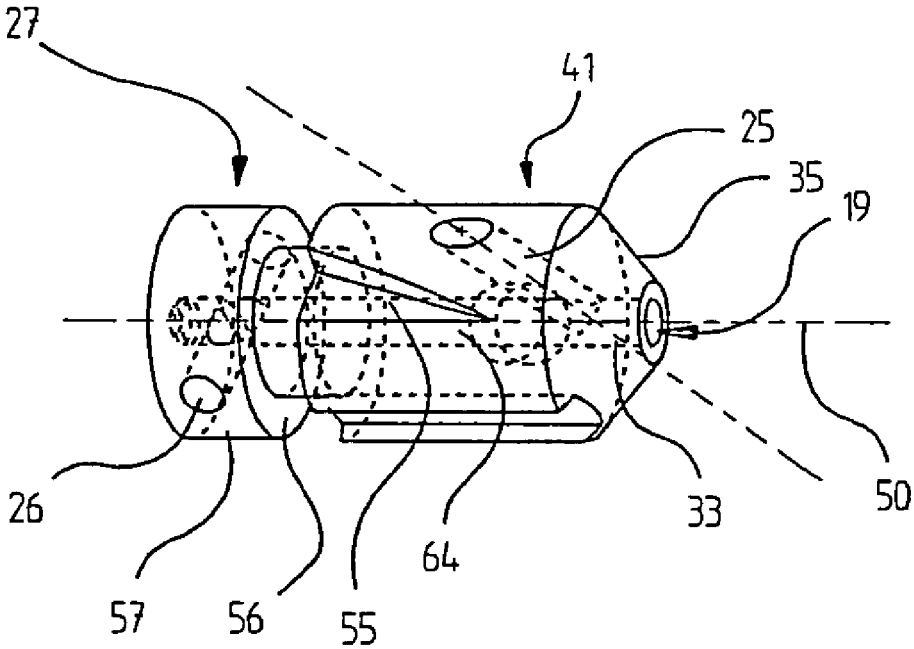
FIG 13

DEVICE FOR INTRODUCING AN ACCURATELY DOSABLE AMOUNT OF MERCURY.

CROSS REFERENCE TO RELATED APPLICATION

The present application claims priority from European Patent Application No. 06007445.7, filed Apr. 7, 2006, the contents of which is herein incorporated by reference in its entirety.

BACKGROUND OF THE INVENTION

The invention relates to a method for introducing an accurately dosable amount of mercury into the discharge vessel of a lamp, in particular into a straight fluorescent lamp. The discharge vessel is connected to a lamp receptacle and is charged with a gas stream via the lamp receptacle and is filled, moreover, with a predetermined amount of mercury via a mercury-introducing channel. Furthermore, the invention relates to a suitable device.

Fluorescent lamps are manufactured on fully automated production machines, where the lamp blanks run through a plurality of processes in the horizontal position. These processes include: baking out the fluorescent substances, which are suspended in the discharge vessel, melting an electrode into the ends of the discharge vessel, evacuating the discharge vessel, filling the discharge vessel with an inert fill gas, introducing a predetermined amount of mercury and then sealing air-tight the discharge vessel on both ends of the discharge tube.

The documents U.S. Pat. No. 2,699,279, U.S. Pat. No. 2,842,290 and U.S. Pat. No. 2,726,799 describe how liquid mercury is dosed from a container as a part of a fully automated production machine for evacuating and filling straight discharge vessels with inert fill gas and mercury.

Such fully automated production machines are wide spread and have been used for many years.

An alternative method for introducing mercury into the discharge vessel of fluorescent lamps is disclosed in WO 97/19461. In the method described in that patent, a metal strip, which is coated with a mercury compound is mounted on the electrodes. After the discharge vessel has been sealed air-tight, in particular melt-sealed, the metal strip and the mercury compound on said metal strip are heated inductively; and the mercury is released.

The heating of the mercury strip in the finished lamp has the result that eventually other undesired components, in particular $H_2$, are released from the metal strip; and these components have an extremely negative impact on the igniting and burning properties of the lamp.

In order to absorb at least to some extent these disturbing materials, a getter material is usually also applied on the metal strip. This getter material must also be heated inductively in order to activate itself. The heating that is necessary to activate the getter or rather to release the mercury is achieved by introducing inductive energy. In order to heat the metal strip up to a range between 900° and 1,000° over a period ranging from 10 to 30 seconds, a very strong alternating electromagnetic field must be applied. A certain radiation of the antenna in the factory, which could have a negative impact, for example, on persons with cardiac pacemakers, cannot be avoided. The energy costs for a lamp throughput of 7,000/h is noticeable; and the energy efficiency of this method is extremely low. The production of the metal strip with the mercury and getter compounds that are applied by pressure on said metal strip (usually in the shape of a welded ring) and the manipulation during the lamp production makes the getter strip technology very time-consuming and expensive.

In the aforementioned Hg-liquid dosing method the scattering of the dosed amount is very large. Depending on the type of lamp, the fluorescent material and other specific construction features, there is a consumption of the introduced mercury during the service life, which ought to be in a magnitude of 20,000 hours. Therefore, one usually overdoses in order to make sure that one has the minimum amount of mercury that is necessary for operating the lamp and to guarantee the envisaged average life of the lamp.

In contrast, the object of the present invention is to provide a method for introducing an accurately dosable amount of mercury into the discharge vessel of lamps. This method is to ensure that the dosing can be carried out with significantly higher accuracy than with the prior art methods. Furthermore, a corresponding device shall be provided.

According to a core idea of the invention, this problem is solved in that in a preparation step during or after dosing the amount of mercury to be introduced, the mercury is brought in a dosed volume in the form of a single, coalescing drop or adherent drop. Then in a fill step the entire amount of mercury to be introduced is transported—while still maintaining the previously formed drop—into the discharge vessel. To this end there is a change-over mechanism, which in the preparation step guides the gas stream past the drop via a bypass channel and in a fill step blocks the bypass channel in such a manner that, while the bypass channel is blocked, the gas stream is guided over the dosed volume and drags the drop along with it into the discharge vessel.

Consequently one core consideration consists of bringing the entire gas stream for the process of introducing behind the already pre-dosed drop of mercury in order to let the drop be conveyed by the gas stream into the discharge vessel.

Even though the dosing of the drop could already be carried out spatially separately or temporally far in advance, it is preferred that the dosing be carried out by means of or rather within the dosed volume. However, it is ensured that exactly the pre-dosed amount of mercury is available for filling into the discharge vessel.

According to another preferred aspect of the present invention, the drop is formed as a structure having at least an approximately spherical shape. Correspondingly in another preferred design, the device is provided with a dosing borehole, which is dimensioned in such a manner that in said borehole the drop can form into a single bead, whose predetermined diameter is defined by the circumference of the dosing borehole.

Therefore, the dosing borehole is configured differently than in the state of the art so that the drop has room only as a bead, a feature that is also claimed as an independent idea of the present invention. In the state of the art, on the other hand, the dosing borehole is designed oblong or long stretched-out so that the mercury divides into a plurality of small beads. However, this division is not repeatable; the beads are small and are poorly conveyed.

In the preferred design of the invention, however, the inventive dosing of the mercury so as to form a single bead as well as the process control or process technological adaption with respect to rerouting or bypassing the gas stream interact.

In order to further improve the introduction of the drop of mercury, it is advantageous to avoid bypasses at angles greater than or equal to 90°. For example, the drop may be guided over two bypasses of, for example, 45° each. As an alternative, it is also conceivable to guide the drop in a channel, which exhibits in particular a continuous bend, especially by providing a curved acceleration channel in such a manner that sharp angles are totally avoided. Especially if a curved acceleration channel is provided, it may also be provided that this channel empties without a bend and/or without any steps into the feed channel. The above described aspects are also claimed as independent inventions irrespective of the formation of exactly one drop or the rerouting of the gas stream.

In another preferred design the drop of mercury is guided in such a manner that at transitions steps or rather edges in the direction of introduction are avoided. Corresponding transitions may be designed so as to be either totally flat, or the drop may be guided in such a way that the diameter of the guiding mechanisms is expanded at the transitions so that the drop of mercury does not impinge upon any impediment in the direction of travel.

According to a special aspect of the present invention, the dosed volume may be designed as a dosing borehole and may exhibit a length that is equivalent to approximately the diameter of a circle, inscribed in the cross section of the dosing borehole.

According to another aspect of the present invention, the length of the dosing borehole may also be somewhat shorter than the diameter of a circle, inscribed in the cross section of the dosing borehole, in order to ensure that in cutting off the mercury stream above the dosing borehole just one drop actually forms despite the high surface tension of the mercury in the dosing borehole.

SUMMARY OF THE INVENTION

The object of the present invention is also solved from a device-related viewpoint by a device for introducing an accurately dosable amount of mercury into the discharge vessel of lamps, in particular straight fluorescent lamps, comprising at least one lamp receptacle, to which the discharge vessel is attached. Furthermore, the device is characterized in that the lamp receptacle exhibits a feed channel, which communicates with the interior of the discharge vessel and that there is a dosing unit, which pre-doses a predetermined amount of mercury in a dosed volume and delivers the amount of mercury that was pre-dosed in the dosed volume to the feed channel for the purpose of introducing into the discharge vessel. The dosed volume is dimensioned in such a manner that the mercury therein forms into a single drop. The dosing unit exhibits a change-over mechanism in order to block and/or reroute, if necessary, a gas stream, flowing through a bypass channel past the dosed volume.

Here, too, the core consideration consists of rerouting, if desired, the gas stream in the introduction phase of the drop of mercury in such a way that the drop is dragged along with the gas stream into the discharge vessel.

It is especially preferred if the dosed volume is designed as the dosing borehole and is dimensioned in such a manner that a drop of at least approximately spherical shape is formed.

According to another aspect of the present invention, the dosing borehole of the inventive device is constructed with walls that are shaped or rather aligned with respect to each other in such a way that the drop, which is formed at least approximately in the shape of a bead, makes only point-by-point or section-by-section contact with the walls of the dosing borehole. Thus, the formation of a bead or rather of a spherical shape of approximately compact structure is promoted; and at the same time friction forces arising during the subsequent release from the dosing borehole are reduced.

In a preferred design the dosing borehole may be formed specifically as a recess, whose cross section exhibits a shape that is essentially in the form of an isosceles triangle. Thereby, the legs of the isosceles triangle in a first design may be arranged to run in a straight line. In an alternative design they may be designed to run in a manner that is convex or concave with respect to the interior of the dosing borehole.

According to another preferred aspect of the present invention, an acceleration channel is provided between the dosing unit and the feed channel. Said acceleration channel is oriented in such a manner that the drop is transferred into the feed channel subject to the action of gravitational force with an additional gravitation-induced momentum. In the state of the art, the mercury, which is divided into a plurality of individual beads and accelerated by gravitational force, also impinges on the feed channel. However, in the state of the art this happens at right angles so that no portion of the momentum remains effective in the longitudinal direction of the feed channel. According to the invention, on the other hand, an additional gravitation-induced momentum is exploited for transporting the mercury inside the feed channel in the direction of the discharge vessel. This aspect is claimed as an invention irrespective of the formation of the mercury in the shape of a single drop or the rerouting of the gas stream.

The acceleration channel and the feed channel may be arranged relative to each other in such a manner that the acceleration channel empties into the feed channel at an angle of $<90°$, preferably $<60°$, furthermore preferably $<50°$. Thus, an undisturbed transport of the mercury from the acceleration channel into the feed channel is guaranteed.

According to another preferred aspect of the present invention, the bypass channel empties into the feed channel and exhibits one or more inflow orifices, which face away from the discharge vessel, for the purpose of charging the discharge vessel with a gas stream, in particular with an inert fill gas.

According to a special aspect of the present invention, the at least one, preferably two or more inflow orifices can be closed with covers. To this end, the inflow orifices are arranged off-axially in relation to the feed channel.

According to a special aspect of the present invention, the inflow orifice(s) and the cover(s) may be opened or closed by rotating the inflow orifices in relation to the covers or by rotating the covers in relation to the inflow orifices.

According to another aspect of the present invention, the dosing unit comprises a tilt spoon unit, which is beared or mounted coaxially to the feed channel and may be tilted between a dosing position and a release position. The tilting action through rotation of the lamp receptacle occurs because owing to its geometric shape and/or owing to an additional trim weight the center of mass of the tilt spoon unit is clearly outside its rotational axis about the feed channel. In this design a separate drive for the tilt spoon unit is not necessary. Rather the dosing position and the release position alternate solely on the grounds of a tilting motion, triggered by the force of gravity, as the lamp receptacles rotate. These lamp receptacles may be spaced, as well-known from the U.S. Pat. No. 2,699,279 or U.S. Pat. No. 2,726,799, equidistant apart from each other in a predetermined number on a circular disk that rotates during the production process.

In another preferred design, the tilt spoon unit comprises a scoop arm with a spoon, mounted on its end. According to a special aspect of the present invention, which ensures an especially fast tilting and thus a highly repeatable dosing or release, the center of mass of the tilt spoon unit is set apart from the rotational axis by a distance that is equivalent to approximately 5% to 25% of the total radial extension of the scoop arm, including the spoon, from the rotational point up to its radially outermost point.

According to another aspect of the present invention, which is also claimed independently, the side of the spoon that faces away from the scoop arm exhibits a roof that tapers off radially outwards, in particular to form a ridge or a peak and that encourages the mercury to run off or drain off the radial exterior or the radial external side of the spoon. This ensures that the mercury, which is located on the radially external side of the spoon, cannot flow along the tilt spoon unit in the direction of the inflow orifice and/or a gas passage borehole (to be explained below), which aligns with the dosing borehole in the release position.

Preferably the feed channel exhibits an upstream first section and a downstream second section, both being oriented coaxially to the other and at the same time beared or mounted in a way that they can rotate about their common axis in opposite directions.

According to a special aspect of the present invention, which is also claimed independently of the dosing and the transport of the drop, which is, if possible in the shape of a bead, and/or the rerouting of the gas stream, a cone surface of the first section engages with an orifice of the second section that faces said first section. The result is that the first section and the second section lie comparatively close to each other, while at the same time the ability to rotate the two sections in opposing directions is preserved.

In order to further improve the sliding seal, the orifice of the second section may exhibit preferably an expansion that is adjusted to the angle of the cone surface.

According to another aspect of the present invention, the first section of the feed channel is mounted rotatably in relation to the assigned lamp receptacle. This feature is achieved preferably in that the first section of the feed channel is rotatably beared or mounted in a dosing sleeve that is rigid in relation to the assigned lamp receptacle. The dosing sleeve may comprise the inventive dosing borehole and may form, furthermore, a bearing for the tilt spoon unit and for a central internal part, in which the bypass channel and the inflow orifice(s) are also formed.

Preferably the first section of the feed channel is formed in a central internal part and is rotatably beared or mounted in a dosing sleeve that is rigid in relation to the assigned lamp receptacle.

The bypass channel may be formed preferably in the central internal part. One end of said bypass channel empties into the first section of the feed channel. The other end of said bypass channel forms one or more inflow orifice(s) for the entry of a gas stream into the bypass channel.

In another preferred design the aforementioned covers for closing the inflow orifice(s) in relation to the rigid dosing sleeve are formed stationarily, preferably as one piece with the dosing sleeve.

In a specific embodiment, the result is that, as the tilt spoon unit is swung in relation to the rigid dosing sleeve, the inflow orifices are brought simultaneously into coincidence with the covers or out of coincidence with the covers. In particular, the result is that in a preparation step the inflow orifices are not covered by the covers so that in the preparation step the gas stream flows through the inflow orifices over the bypass channel past the drop. Not until the fill step are the inflow orifices blocked by the covers by rotating the dosing sleeve in relation to the internal part so that in this way the bypass channel is blocked. Then the gas stream is guided over the dosed volume and drags the drop along with it into the discharge vessel.

The tilt spoon unit may be provided with an aforementioned gas passage borehole, which aligns with the dosing borehole in the release position of the tilt spoon unit so that the pressure of the fill gas at the gas passage borehole induces or supports the transport of the drop into the feed channel.

According to another preferred aspect of the present invention, which is also claimed independently, the gas passage borehole may exhibit diverter or deflector means, in particular a diverter or deflector sleeve, in order to keep excess mercury, draining from the dosing unit during the respective dosing operation, away from the gas passage borehole. This prevents the mercury, draining off the tilt spoon unit, from flowing into the gas passage borehole and, thus, also prevents additional mercury from flowing into the feed channel to the exactly pre-dosed drop.

BRIEF DESCRIPTION OF THE DRAWINGS

The invention is described in detail below also with respect to other features and advantages with the aid of the description of the embodiments and with reference to the attached drawings.

FIG. 10 is a perspective view of an embodiment of an inventive dosing sleeve;

FIG. 11 is a top view of a dosing sleeve, according to FIG. 10;

FIG. 12 is an internal part of the dosing unit, which is illustrated by means of FIGS. 1 to 8;

FIG. 13 is a perspective view of the internal part, according to FIG. 12;

DETAILED DESCRIPTION OF THE INVENTION

Figure 1:
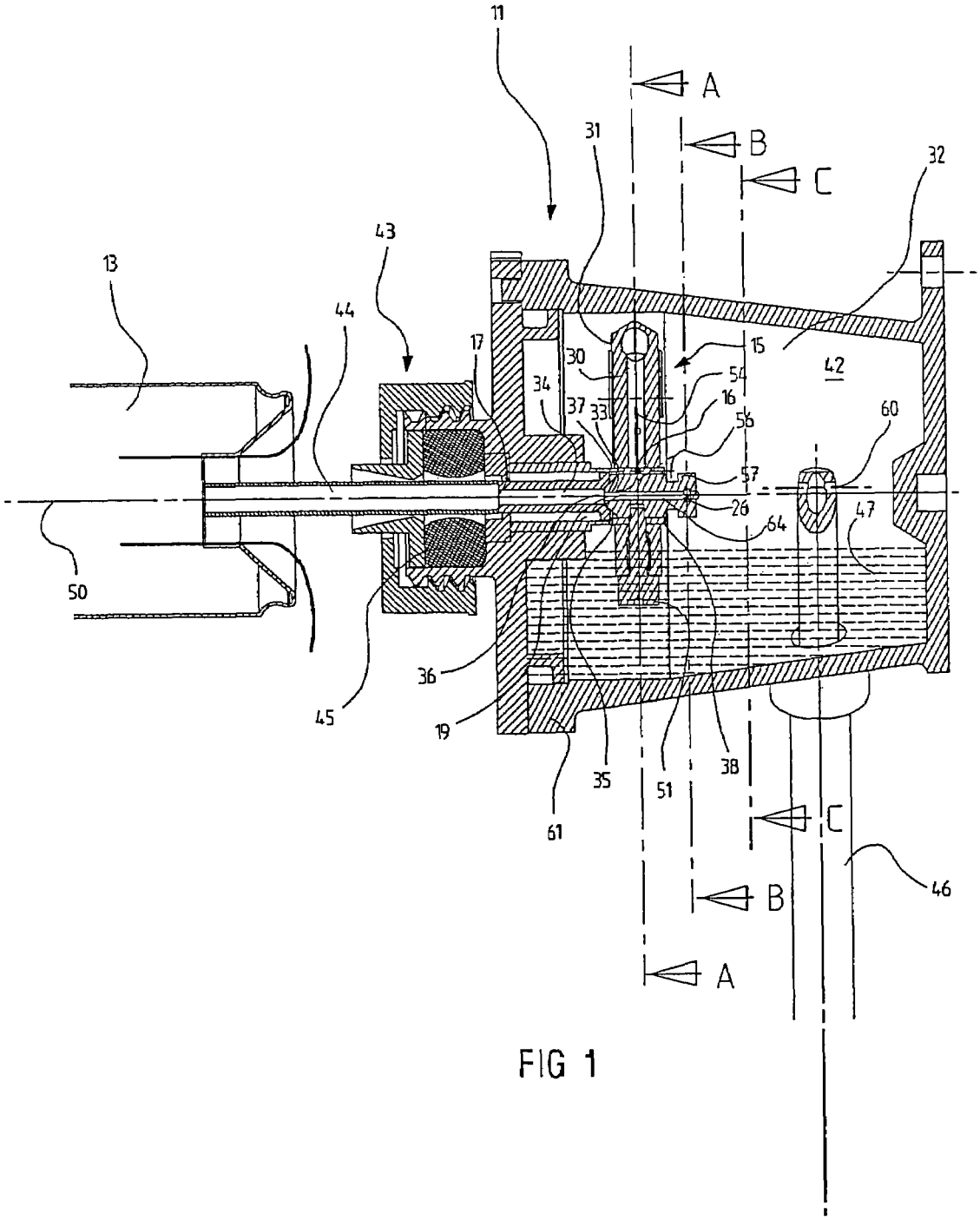
FIG. 1 is a schematic longitudinal sectional view of an embodiment of an inventive lamp receptacle with a dosing unit arranged therein in a first position (preparation step)

FIG. 1 is a longitudinal sectional view of an embodiment of an inventive lamp receptacle 11 in a longitudinal sectional view. The lamp receptacle 11 comprises, first of all, a housing 61 and a holder 43, which is attached to the housing and in which a discharge vessel 13 of a fluorescent lamp, which is to be produced, is held by way of a pump tube 44, which is melted onto the discharge vessel. The holder 43 comprises sealing means 45, which may be made specifically as a ring-shaped sealing rubber.

The discharge vessel 13 is held on its opposite end in a lamp receptacle by way of a holder. Said lamp receptacle may be formed in a way that is different from the lamp receptacle 11, which is described here, but which is well-known from the state of the art. The opposite lamp receptacle may evacuate, for example, the discharge vessel 13 by way of a second pump tube, which is melted on the respective end, and/or may support a flushing operation with a fill gas by means of suction. The standard lamp receptacle 11, which is shown here, comprises an interior 42, which is flow-connected to the discharge vessel 13 via a feed channel 19, which runs in particular in a straight line, when the pump tube 44 is installed. The feed channel 19 defines a central axis 50. The interior 42 of the lamp receptacle 11 may be charged with fill gas by way of a fill gas line 46, which projects with an entry 60 in the vicinity of the axis 50 of the interior 42, which is designed so that it is essentially rotationally symmetrical about this axis 50.

Furthermore, there is a supply or reservoir of mercury, forming a sea of mercury 47, inside the interior 42. The level of the sea of mercury 47 is always sufficiently below the centrally disposed feed channel 19 and the entry 60 of the fill gas line 46.

By means of a dosing unit 15 a predetermined amount of mercury may be transferred from the sea of mercury 47 into the central feed channel 19 and then conveyed into the discharge vessel 13 with the aid of a fill gas stream.

The dosing unit 15 comprises, first of all, a dosing sleeve 38, which is stationary in relation to the lamp receptacle 11 and which is oriented coaxially in relation to the feed channel 19, designed in an internal part 41, and closes said feed channel. The dosing sleeve 38 exhibits an external section 48, with which it is connected in a rotationally rigid manner to the housing 61 of the lamp receptacle 11, as well as an internal section 49, on which a tilt spoon unit 28 is beared or mounted rotatably—as another element of the dosing unit 15—about the axis 50, which is defined by the (central) feed channel 19. By means of an driving or drive type screw 51, which engages with or traverses an oblong or long stretched-out hole 52 in the dosing sleeve 38, the tilt spoon unit 28 carries with it the aforementioned internal part 41, as the third element of the dosing unit 15, with the rotational movement of the tilt spoon unit 28.

The internal part 41 of the dosing unit 15 comprises simultaneously a first section 33 of the feed channel 19 as well as a bypass channel 64, which empties into this first section 33 of the feed channel 19. Thus, the first section 33 of the feed channel 19 as well as the bypass channel 64 are beared or mounted rotatably about the axis 50 in relation to the housing of the lamp receptacle 11. Of course, it is conceivable from a purely theoretical viewpoint to attach the pump tube 44 directly to this first section 33 of the feed channel 19. However, the feed channel 19 is preferably extended by a second section 34, which is flow-connected on its one side to the pump tube 44 and is flow-connected on the opposite side to the first section 33, which is rotatably beared or mounted. The said second section 34 is designed in a stationary manner as a separate component or integrally with the dosing sleeve 38 in relation to the housing of the lamp receptacle 11.

According to an independently inventive aspect of the present invention, the first section 33 of the feed channel 19 exhibits a cone surface 35 on its end facing the second section 34 in order to improve the interaction with the second section 34 of the feed channel. Said cone surface engages with the assigned orifice 36 of the second section 34. Preferably the second section 34 exhibits simultaneously on its orifice 36 an expansion 37, which is adjusted to the cone surface 35 of the first section 33, so that the occurrence of an uncontrolled gap, as in the case of the state of the art, is avoided as far as possible.

The tilt spoon unit 28 can be tilted by rotating the lamp receptacle 11 (a feature that shall be described in detail below with the aid of the explanation with respect to FIG. 3) between a dosing position (preparation step) and a release position (fill step). The dosing position or the release position represents the end positions of a rotational movement of the tilt spoon unit 28 about the axis 50 of the feed channel 19 or rather the dosing sleeve 38, on which the tilt spoon unit 28 is beared or mounted, as described above. These end positions are defined by means of the dimensions of the oblong hole 52 in the dosing sleeve 38.

Figure 2:
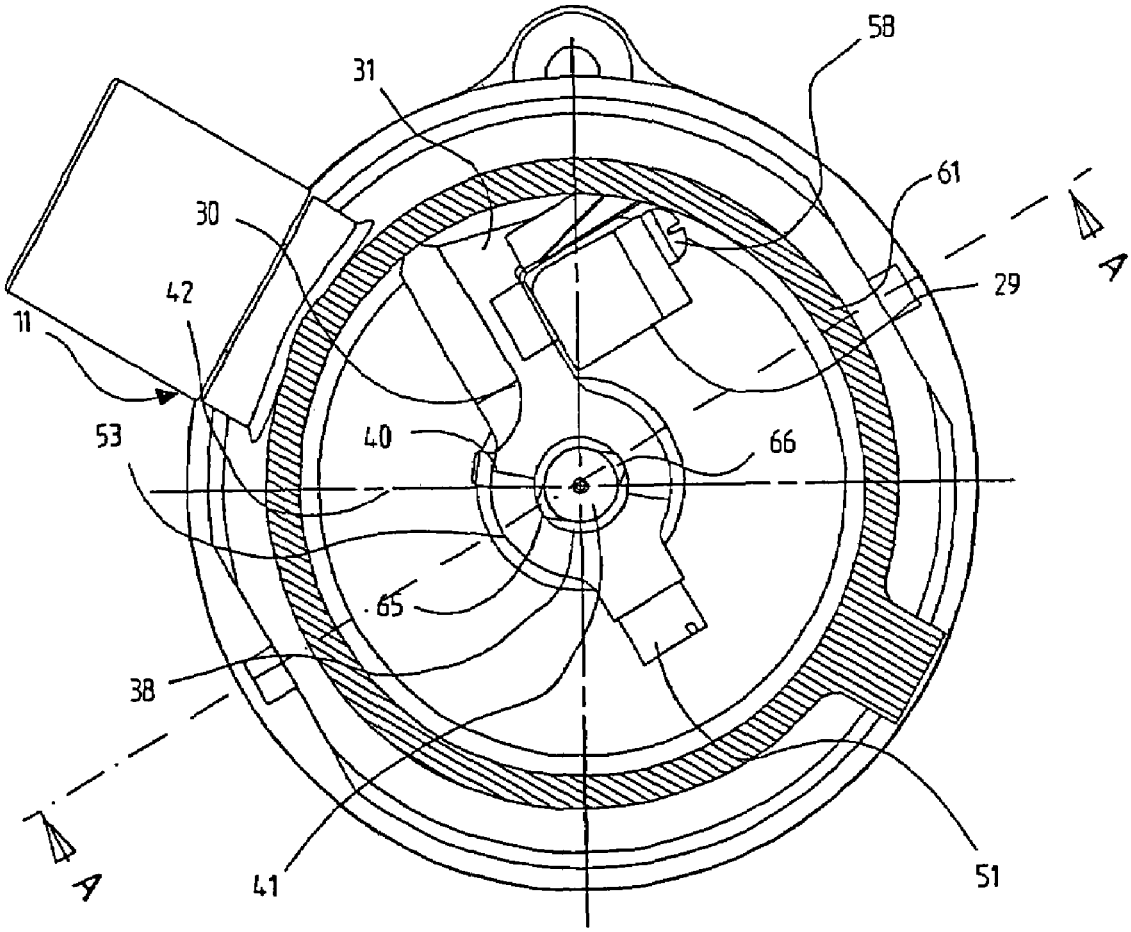
FIG. 2 is a sectional view of the lamp receptacle with a dosing unit arranged therein along the line C-C in FIG. 1.
Figure 3:
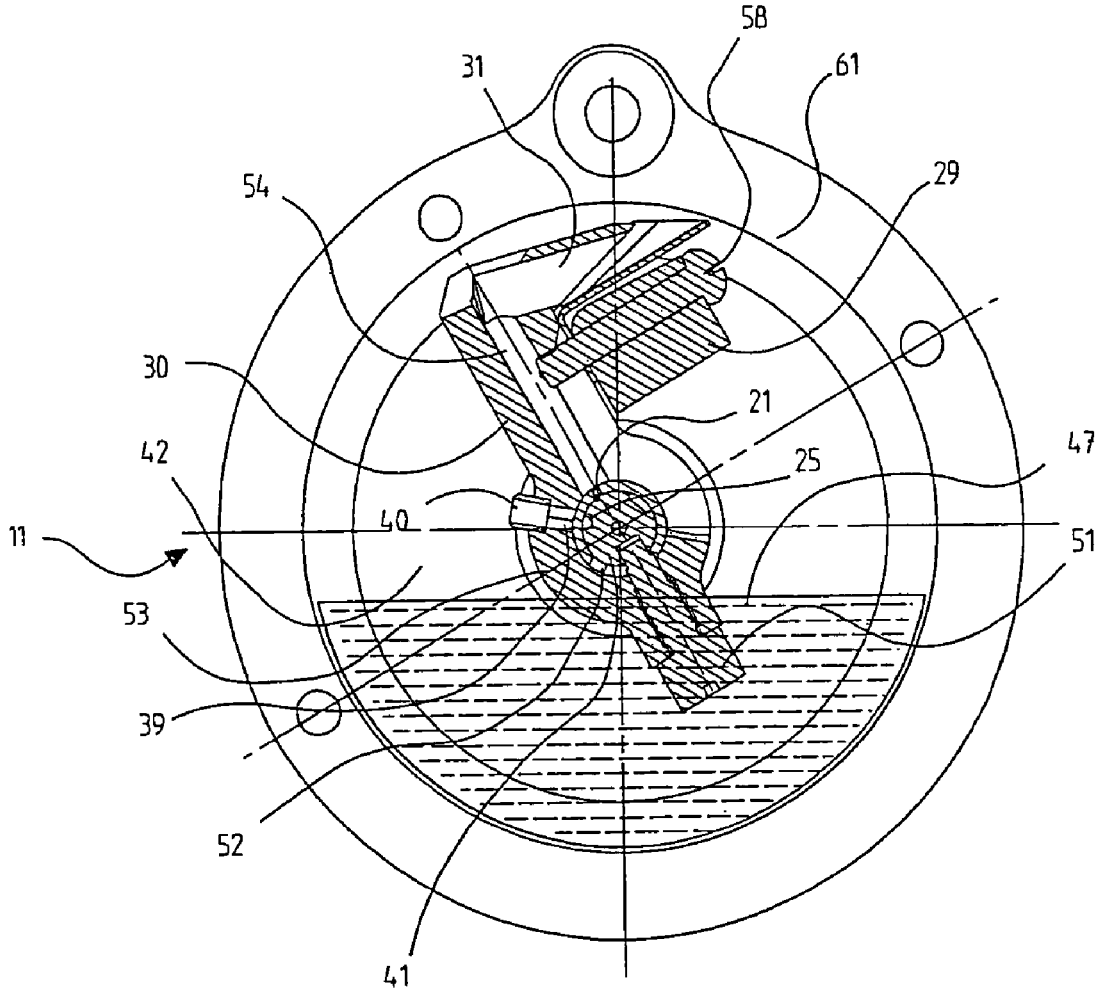
FIG. 3 is a sectional view of the lamp receptacle with a dosing unit arranged therein along the line A-A in FIG. 1.
Figure 4:
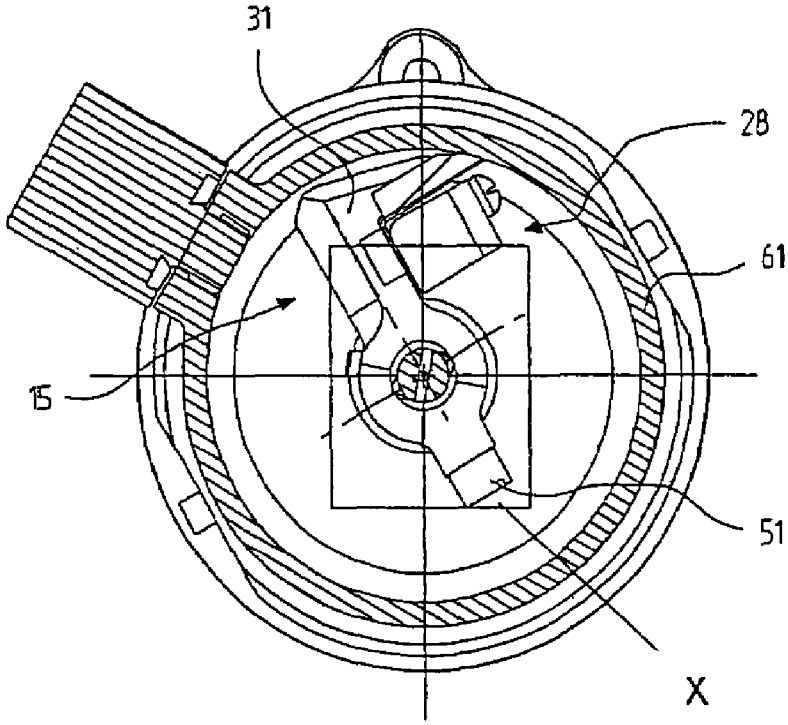
FIG. 4 is a sectional view of the lamp receptacle with a dosing unit arranged therein along the line B-B in FIG. 1.
Figure 4:
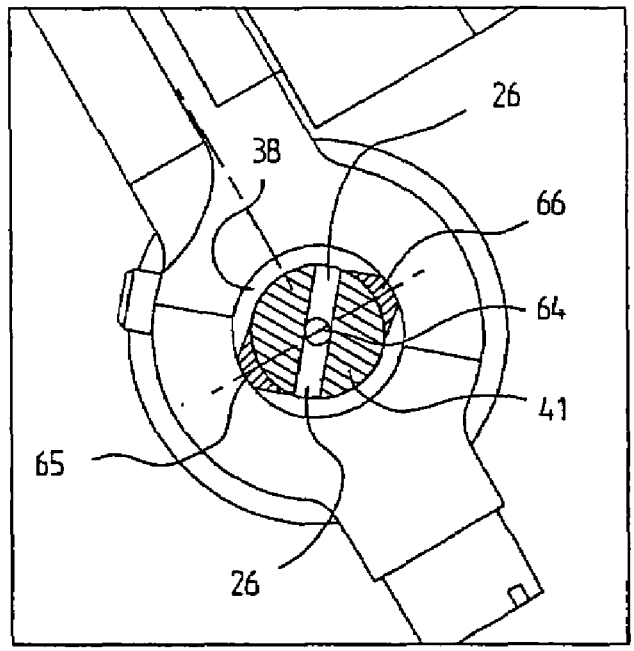

In FIG. 2 the lamp receptacle 11 is shown along the line C-C from FIG. 1; in FIG. 3, along the line A-A from FIG. 1; and in FIG. 4, along the line B-B from FIG. 1. In this representation the tilt spoon unit 28 is located in its first position, i.e., the dosing position (preparation step).

As FIGS. 2, 3 and 4 show, the tilt spoon unit 28 comprises a spoon 31, which lies radially outwards in relation to the axis 50 and which is connected to an essentially ring-shaped internal section 53 by way of a scoop arm 30. In a preferred embodiment the spoon 31, the scoop arm 30 and the essentially ring-shaped internal section 53 are designed as one piece. By means of the spoon 31, which is shown in FIG. 3 as partially broken open, the tilt spoon unit 28 may pick up mercury from the sea of mercury 47 and guide it specifically to a dosing borehole 21 in the dosing sleeve 38 by means of a channel 54 inside the scoop arm 30. In order to ensure that the dosing borehole 21 is filled with mercury as completely as possible, an outlet 55 is provided in the internal part 41 of the dosing unit 15. The said outlet 55 of the internal part 41 in the dosing position of the tilt spoon unit 28 aligns with the dosing borehole 21.

The end of the dosing sleeve 38 that faces away from the external section 48 also exhibits two covers 65, 66, which project in the axial direction beyond the internal section 49 and form a part of a change-over mechanism 63 (to be explained in detail below) for the gas stream guided into the discharge vessel 13. The covers 65, 66 exhibit an internal surface 67, 68, which is rounded to match the radius of the diverter disk or deflector disk 57 and which slides as close as possible over the outside of the diverter disk 57. In the release position (fill step) the covers 65, 66, which are formed as anchor necks or anchor palms, projecting beyond the internal section, cover the inflow orifices 56, which are formed diametrically on the shell side of the diverter disk 57, in the internal part, so that in the fill step the gas stream is blocked by the bypass channel 64. In the dosing position (preparation step), however, the internal part 41 and the dosing sleeve 38 are rotated in the opposing direction in such a manner that the covers 65, 66 do not cover the diametrically arranged inflow orifices 26 in the diverter disk 57, so that the gas flow may enter into the bypass channel 64 by way of the inflow orifices 26 and from there may enter into the discharge vessel 13 by way of the first section 33 of the feed channel 19 and the second section 34 of the feed channel 19. The bypass channel 64 and the first section 33 of the feed channel 19 may be designed as a continuous borehole, which is closed by a cap 69 on the end facing away from the discharge vessel.

At the same time the T-shaped side channels lead to the two diametrically opposite inflow orifices 26.

The process that is controlled by the tilt spoon unit 28 is explained once again below in this context. If, after the dosing borehole 21 is filled with a predetermined amount of mercury, the tilt spoon unit 28 is tilted into the release position (by tilting clockwise out of the dosing position shown in FIGS. 2, 3 and 4), a gas passage borehole 39 in the ring-shaped internal section 53 of the tilt spoon unit 28 moves into an orientation that aligns with the dosing borehole 21. At the same time this tilting movement of the tilt spoon unit 28 takes with it the internal part 41 of the dosing unit 15 so that even an acceleration channel 25 inside the internal part 41 moves into an aligned orientation with the dosing borehole 21. At the same time the rotational movement of the internal part 41 closes in relation to the dosing sleeve 38 the inflow orifices 26 of the bypass channel 64 by means of the covers 65, 66 so that at this stage the gas flow is guided through the dosing borehole 21 and drags the drop 16 with it into the discharge vessel 13. This release position, i.e., the position of the dosing unit 15 in the fill step, is illustrated with the aid of FIGS. 5 to 8.

In the present embodiment the dosing borehole is formed in the shape of a triangular hole 18, i.e., as a passage borehole with a triangular cross sectional shape. In the present embodiment the triangle is an isosceles triangle with straight legs. Yet at the same time even diverging shapes are conceivable. One consideration in this design is that the mercury, received in the dosing borehole 21, forms into a single drop 16, which has as few contact points as possible with the walls 22 to 24 of the dosing borehole 21. If, based on the European specifications, one doses with a predetermined maximum amount of mercury of 5 mg or 10 mg (depending on the type of lamp), the calculated diameter of the drop 16, exhibiting as spherical a shape as possible, is equal to 0.89 mm or 1.12 mm.

In the release position of the tilt spoon unit 28 the drop 16 of mercury that is formed in the dosing borehole may enter into the acceleration channel 25 of the internal part 41. In the present embodiment the acceleration channel 25 inside the internal part 41 is arranged at an angle of 45°. Thus, on the one hand, a 90°-transition during transport of the drop 16 from the dosing borehole 21 into the feed channel 19 is avoided, a feature that in the state of the art renders the transport of the mercury difficult. In addition, in the orientation of the acceleration channel 25 that is proposed here, the drop 16 is also accelerated by the force of gravity, acting on said drop, without totally losing this momentum upon entering the feed channel 19. In addition, transitions 17 between the dosing borehole 21 and the acceleration channel 25 or between the acceleration channel 25 and the feed channel 19 or between the feed channel 19 and the pump tube 44 are designed in such a manner that the drop 16 in the direction of transport does not impinge on any impediment that is designed as steps.

In addition, in an inventive construction there are a number of measures, which are also claimed independently as inventive, in order to avoid an undesired entry of the mercury past the dosing borehole 21. First, the internal part 41 of the dosing unit 15 is provided with a diverter mechanism or deflector mechanism 27 on its end facing away from the pump tube 44. This diverter mechanism 27 is designed to avoid an undesired entry of the mercury, running up the tilt spoon unit 28, into the inflow orifice 26 of the feed channel 19 that faces away from the pump tube 44. The diverter mechanism 27 is designed here specifically in the shape of a groove 56.

In order to prevent the mercury from running as fast as possible precisely down outsides of the spoon 31, which is located at the top in the dosing position, another independent aspect of the present invention provides that this topside of the spoon 31 is designed as a roof 32 (cf. FIG. 1), i.e., with surfaces that are sloped or inclined towards the horizontal, so that the mercury may drain off. Finally diverter means or deflector means 40 are also disposed on the gas passage borehole 39, which is provided in the ring-shaped internal section 53 of the tilt spoon unit 28 and which may be designed here specifically as a projecting sleeve (cf. FIG. 3). This, too, prevents the mercury, draining off the tilt spoon unit 28, from entering directly into the feed channel 19 without passing the dosing borehole 21.

In order to ensure that the tilt spoon unit 28 tilts as fast as possible between the dosing position and the release position, thus creating the defined conditions (in order to have the least possible negative effect on the design of the drop 16 having an essentially spherical shape), the tilt spoon unit 28 is also provided with an additional trim weight 29, which is fastened on the scoop arm 30 in the vicinity of the spoon 31 by means of a fastening screw 58.

Figure 9:
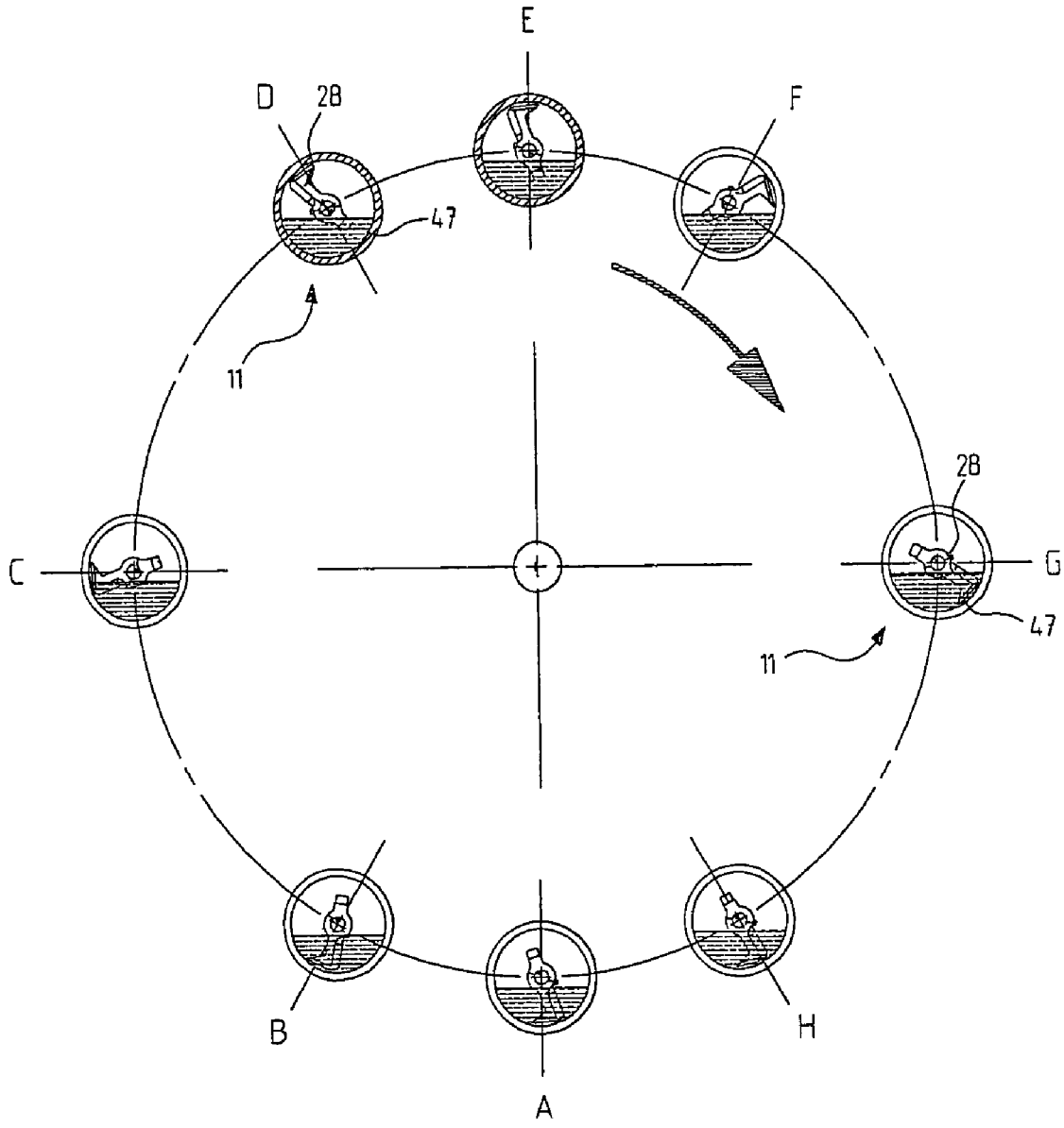
FIG. 9 is a diagrammatic sketch, which shows an embodiment of the dosing unit with the tilt spoon unit during the rotation of the assigned pump/filling machine, which may be provided with a plurality of lamp receptacles for receiving a respective discharge vessel.

FIG. 9 is a schematic sketch of the rotation of the pump/filling machine, to which a plurality of lamp receptacles 11 may be fastened. Thus, the plurality of lamp receptacles 11 rotates about a central rotational axis of the pump/filling machine along a circular path. In so doing, on the one hand, the sea of mercury 47 shifts in the interior 42 of the respective lamp receptacles 11. At the same time the tilt spoon unit 28 tilts periodically from the dosing position (preparation step) into the release position (fill step) and from the release position back again into the dosing position.

In the positions A and B, the spoon 31 is totally submerged in the sea of mercury 47 and emerges, filled with mercury in position C, from the sea of mercury 47 so that both the spoon 31 and the channel 54 are filled with mercury. In positions D and E, the tilt spoon unit 28 is still located in the dosing position, where at this stage now the mercury in the channel 54 can flow into the dosing borehole 21. In positions F and G, the tilt spoon unit 28 is transferred into the release position by a fast tilt motion so that the bead 16 of mercury that has formed in the dosing borehole 21 can enter into the central feed channel 19 by way of the acceleration channel 25 and from there can enter into the discharge vessel 13.

This operation is supported by a fill gas thrust, which may be generated, for example, by generating such an underpressure on the opposite side of the discharge vessel in the discharge vessel that at the correct instant at which the bead 16 reaches the entry of the pump tube 44, a fill gas thrust is passed on from the fill gas line 46 into the feed channel 19 by way of the inflow orifice 26 and/or the gas passage borehole 39.

In position H the tilt spoon unit 28 is tilted from the release position back into the dosing position.

FIG. 10 is a perspective view of the dosing sleeve 38. The dosing sleeve 38 comprises the aforementioned external section 48 for installing into the housing 61 of the lamp receptacle 11 as well as an internal section 49, whose outside diameter is smaller. This internal section 49 exhibits the aforementioned oblong hole 52 as well as the dosing borehole 21, formed with a triangular cross section. FIG. 11 is a side view of the dosing sleeve 38 in FIG. 10.

FIG. 12 is a side view, and FIG. 13 is a perspective side view of the internal part 41 of the dosing unit 15. The internal part 41 comprises the aforementioned first section 33 of the feed channel 19. In order to connect to the second section 34 of the feed channel 19, the internal part 41 exhibits the aforementioned cone surface 35 on its one face-sided end or frontal end. On its opposite end the central, continuous first section 33 of the feed channel 19 exhibits the inflow orifice 26, which was also mentioned above and which is shielded as well as possible against an undesired inflow of mercury by means of the groove 56, comprising the diverter means 27 and the diverter disk 57. Starting from the shell surface of the internal part 41, the acceleration channel 25 extends at a 45° angle in the direction of the first section 33 of the feed channel 19. Furthermore, there is a borehole 59 for receiving the driving screw 51 (not illustrated here) as well as the outlet 55 for carrying away the mercury in the filling process of the dosing borehole 21 of the assigned dosing sleeve 38.

Figure 5:
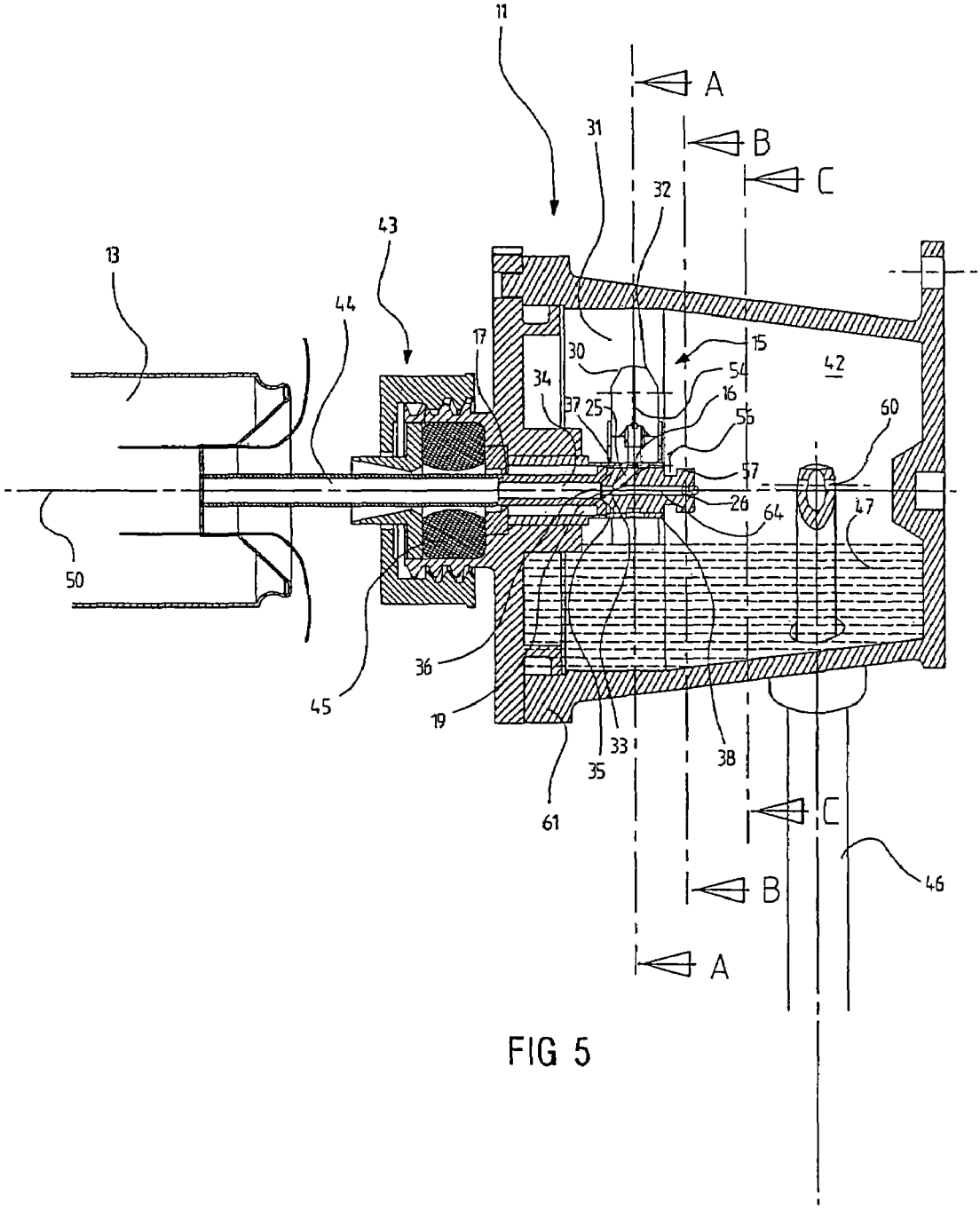
FIG. 5 is a schematic longitudinal sectional view of the embodiment of an inventive lamp receptacle with a dosing unit arranged therein, according to FIG. 1, in a second position (fill step)
Figure 6:
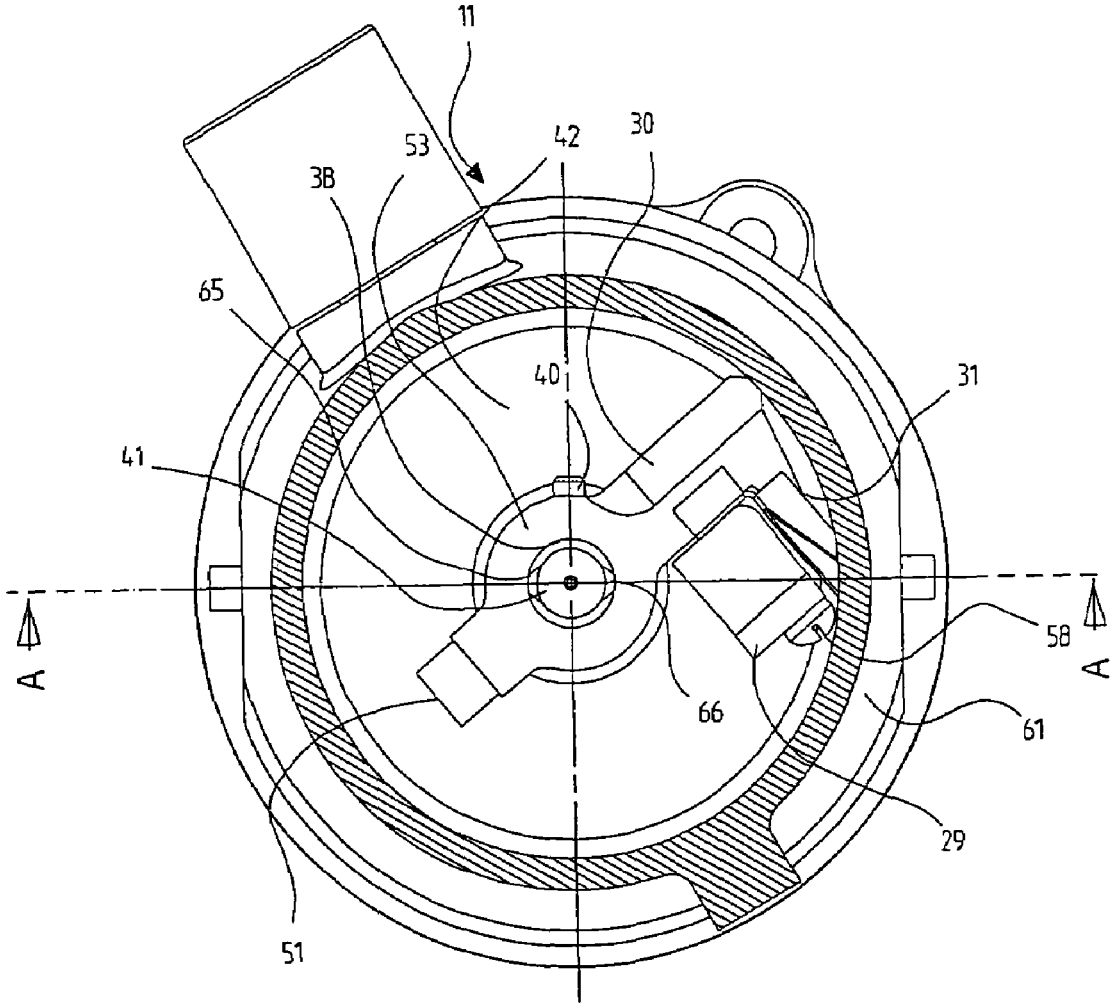
FIG. 6 is a sectional view of the lamp receptacle with a dosing unit arranged therein along the line C-C in FIG. 5.
Figure 7:
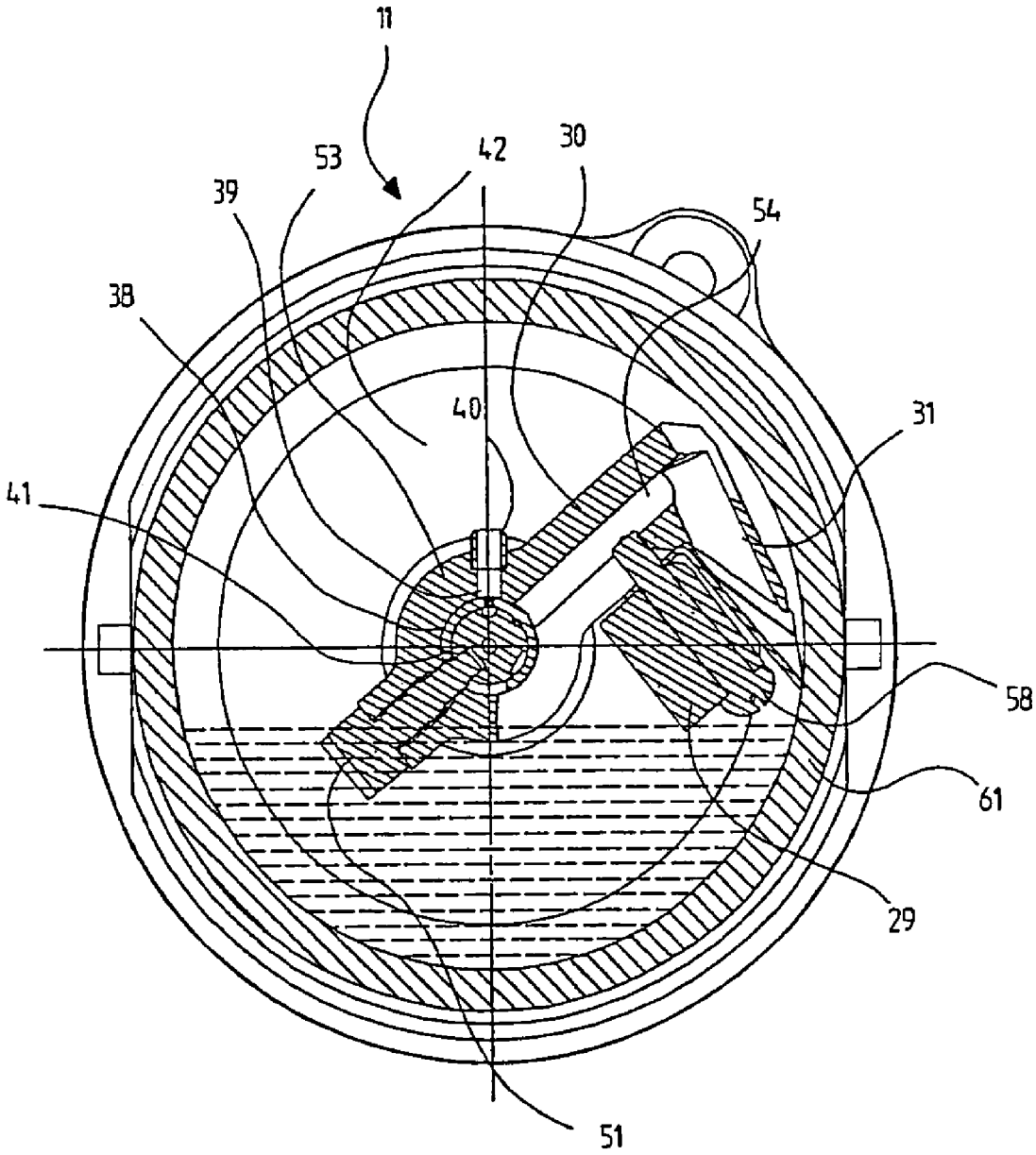
FIG. 7 is a sectional view of the lamp receptacle with a dosing unit arranged therein, in a sectional view along the line A-A in FIG. 5.
Figure 8:
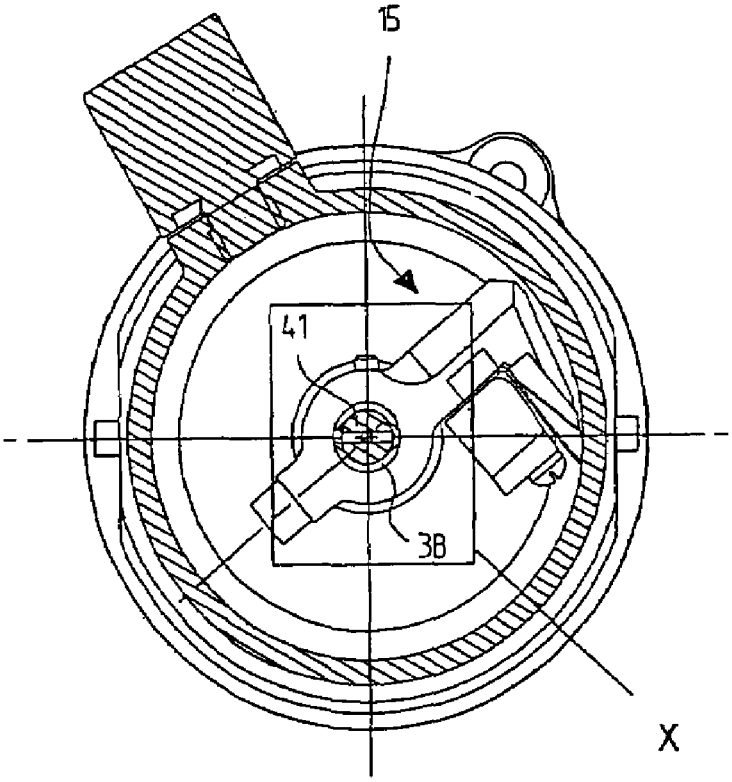
FIG. 8 is a sectional view of the lamp receptacle with a dosing unit arranged therein, in a sectional view along the line B-B in FIG. 5.
Figure 8:
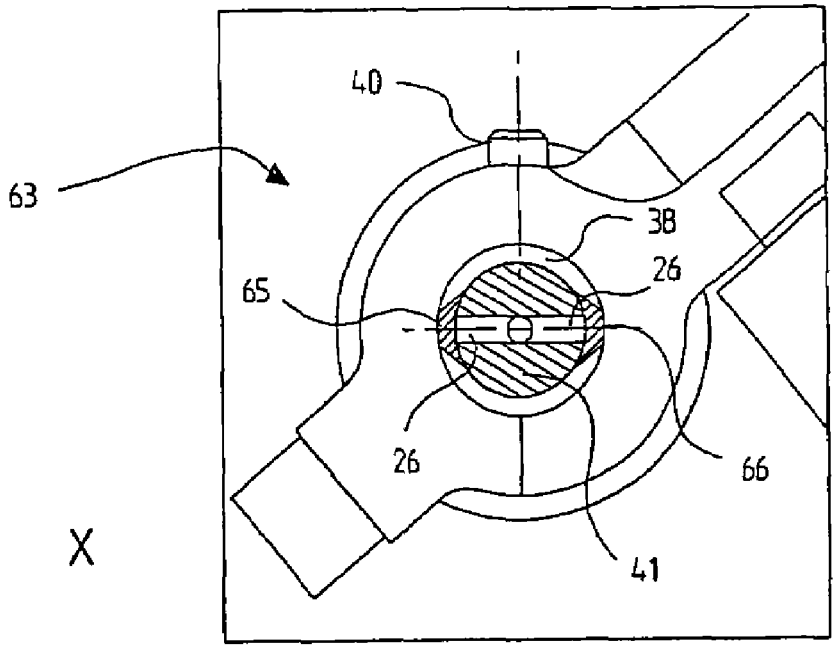
Figure 14:
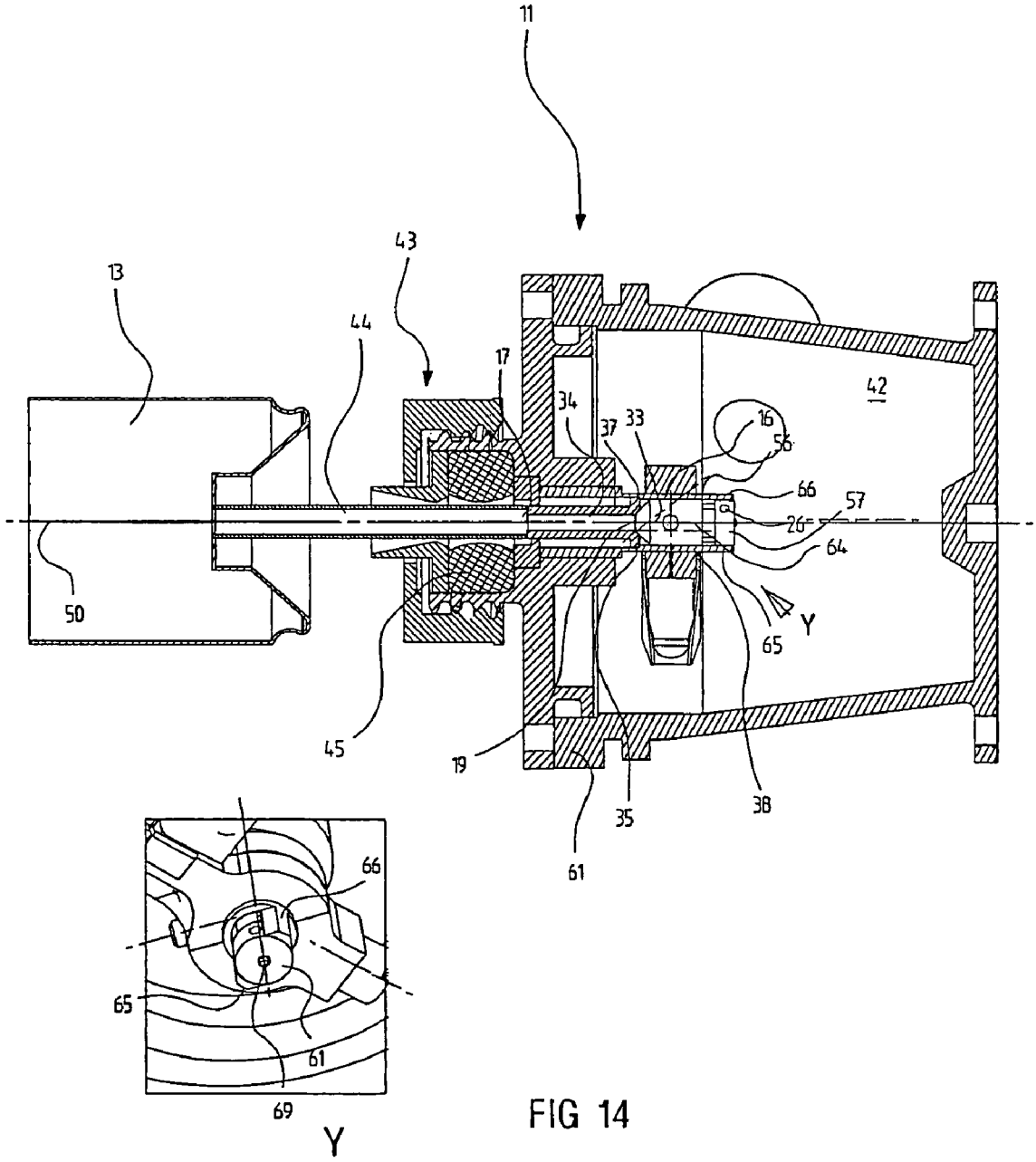
FIG. 14 is a longitudinal sectional view, which deviates from the drawing in FIG. 1, along the line A-A in FIG. 2 of the inventive lamp receptacle with a dosing unit, arranged therein, in a first position (preparation step) in order to explain the bypass mechanism.
Figure 15:
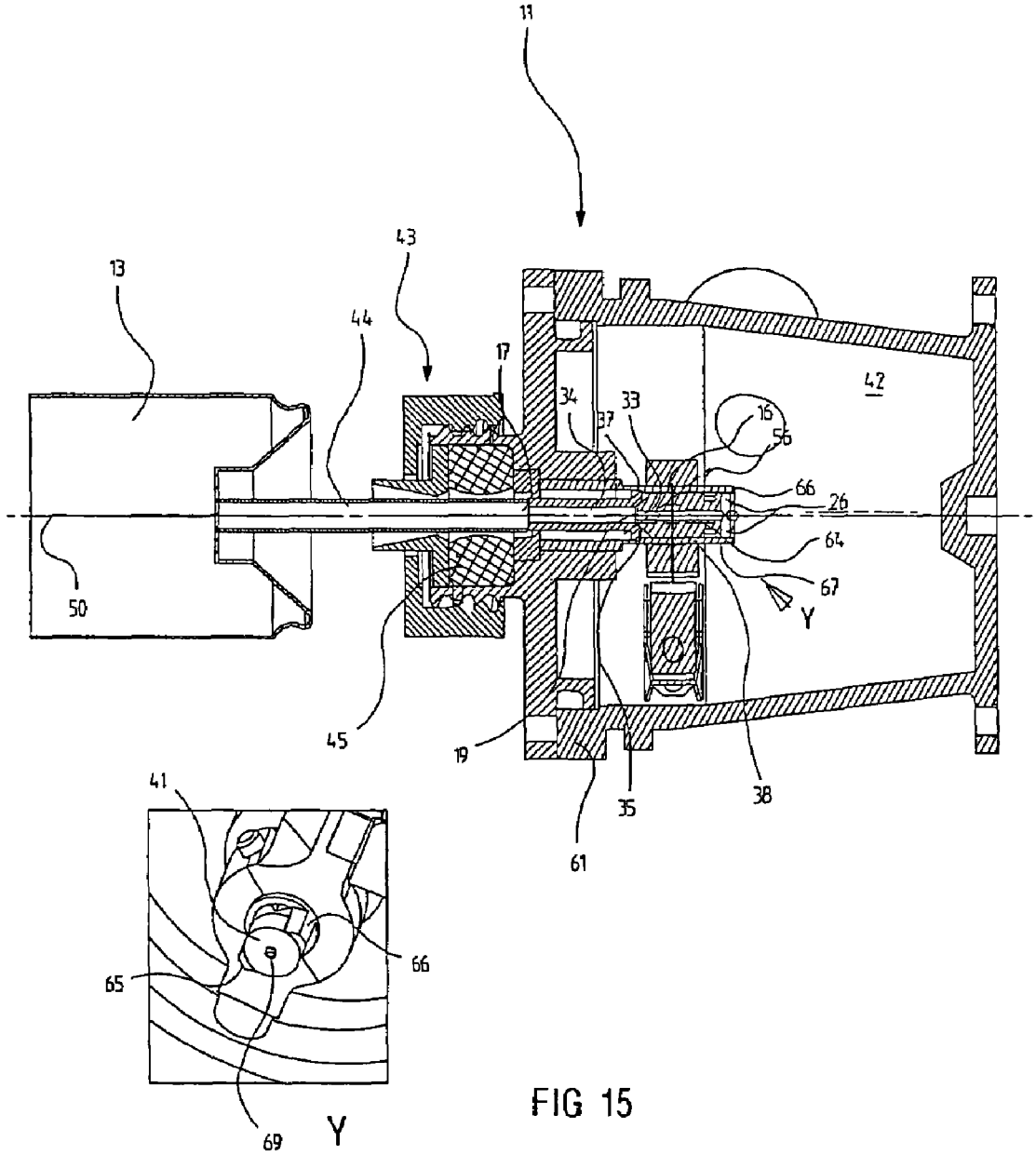
FIG. 15 is a longitudinal sectional view along the line A-A in FIG. 6 of the lamp receptacle with a dosing unit, arranged therein, in order to explain the bypass mechanism in the second position of the dosing unit (fill step).

FIGS. 14 and 15 are sectional views that are different from the drawings in FIGS. 1 and 5 in order to illustrate how the change-over mechanism 63 works. The change-over mechanism comprises the diametrically arranged inflow orifices 26 in the internal part 41 as well as the covers 65, 66, which are made as one piece with the dosing sleeve 38. FIG. 14 illustrates the dosing position (preparation step). In this position the change-over mechanism 63 guides the gas stream through the inflow orifices 26 and the bypass channel 64 past the dosing borehole 21, which is configured as a triangular hole 18.

FIG. 15 shows the arrangement in the release position (fill step). In this position of the change-over mechanism 63 the covers 65, 66 close the inflow orifices 26 of the bypass channel in such a manner that at this stage the gas stream is guided over the dosed volume or rather the dosing borehole 21 and in this way drags the drop 16 with it into the discharge vessel 13.

With the dosing unit proposed here, or rather the method proposed here, the absolute amount of mercury per lamp may be dosed with significantly higher accuracy and reliability. Owing to the small scattering as compared to the conventional liquid dosing method, an underdosing and any resulting early failure of the lamp due to such a scattering may be avoided. Furthermore, an inadvertent overdosing is avoided with significantly higher certainty.

What is claimed is:

1. A device for introducing an accurately dosable amount of mercury into the discharge vessel of lamps, comprising at least one lamp receptacle, to which the discharge vessel is attached, wherein the lamp receptacle exhibits a feed channel, which communicates with the interior of the discharge vessel, and wherein there is a dosing unit comprising a first, rotational section and a second, stationary section disposed along a common axis, which pre-doses a predetermined amount of mercury in a dosed volume and delivers the amount of mercury that was pre-dosed in the dosed volume to the feed channel for the purpose of introducing into the discharge vessel, wherein the dosed volume is dimensioned in such a manner that the mercury therein forms into a single drop, and wherein the dosing unit comprises a change-over mechanism in order to at least one of block or reroute a gas stream, flowing through a bypass channel past the dosed volume.

2. The device as claimed in claim 1, wherein the dosed volume is formed as a dosing borehole and is dimensioned in such a manner that a drop, whose shape is at least approximately spherical, is formed; and wherein said dosing borehole is formed as a recess, whose cross section exhibits a shape that is essentially in the form of an isosceles triangle.

3. The device as claimed in claim 2, wherein the dosing borehole comprises walls that are shaped and aligned in such a way in relation to each other that the drop, which is formed at least approximately in the spherical form of a bead, makes only point-by-point or section-by-section contact with the walls of the dosing borehole.

4. The device as claimed in claim 1, wherein a straight or curved acceleration channel is provided between the dosed volume and the feed channel in such a manner that the drop is transferred into the feed channel subject to the action of gravitational force with an additional gravitation-induced momentum.

5. The device as claimed in claim 4, wherein the straight or curved acceleration channel empties into the feed channel at an angle <90°.

6. The device as claimed in claim 1, wherein the bypass channel empties into the feed channel and exhibits one or more inflow orifices, which face away from the discharge vessel, for the purpose of charging the discharge vessel with a gas stream, in particular with an inert fill gas.

7. The device as claimed in claim 6, wherein at least one, of the inflow orifices is arranged off-axially in relation to the feed channel and is closed with a cover.

8. The device as claimed in claim 1, wherein the dosing unit comprises a tilt spoon unit, which is beared coaxially to the feed channel and is tilted between a dosing position and a release position, wherein the tilting action through rotation of the lamp receptacles occurs because, owing to at least one of its geometric shape or to an additional trim weight, the center of mass of the tilt spoon unit is clearly outside its rotational axis about the feed channel.

9. The device as claimed in claim 8 wherein the tilt spoon unit comprises a scoop arm with a spoon which is disposed on the end of said scoop arm and that, based on the radial extension of the scoop arm, including the spoon in the radial direction from the rotational axis, defined by the feed channel, the center of mass is set apart from this rotational axis by a distance that is equivalent to approximately 5% to 25% of the total radial extension of the scoop arm, including the spoon.

10. The device as claimed in claim 8, wherein the tilt spoon unit comprises a scoop arm with a spoon, which is disposed on the end of said scoop arm, wherein the side of the spoon that faces away from the scoop arm exhibits a roof that tapers off radially outwards, in particular to form a ridge or a peak and that encourages the mercury to run off or drain off the radial external side of the spoon.

11. The device as claimed in claim 8, wherein the tilt spoon unit exhibits a gas passage borehole, which aligns with a dosing borehole in the release position of the tilt spoon unit so that the pressure of the fill gas at the gas passage borehole induces or supports the transport of the drop into the feed channel.

12. The device as claimed in claim 11, wherein the gas passage borehole exhibits a diverter or deflector sleeve, in order to keep excess mercury, draining from the dosing unit during the respective dosing operation, away from the gas passage borehole.

13. The device as claimed in claim 1, wherein the feed channel exhibits an upstream first section and a downstream second section, both of which being oriented coaxially in relation to the other and at the same time beared or mounted in a way that they can rotate about their common axis in opposite directions, wherein the cone surface of the first section engages with an orifice of the second section that faces said first section.

14. The device as claimed in claim 13, wherein the orifice of the second section exhibits an expansion that is adjusted to the angle of the cone surface.

15. The device as claimed in claim 1, wherein the feed channel exhibits an upstream first section and a downstream second section, both being oriented coaxially to the other and at the same time beared or mounted in a way that they can rotate about their common axis in opposite directions, wherein the first section is beared or mounted rotatably in relation to the assigned lamp receptacle.

16. The device as claimed in claim 1, wherein a first section of the feed channel is formed in a central internal part and is rotatably beared or mounted in a dosing sleeve that is rigid in relation to the assigned lamp receptacle.

17. The device as claimed in claim 16, wherein the bypass channel with one or more inflow orifices is formed in the central internal part.

18. The device as claimed in claim 17, wherein covers for closing the inflow orifices in relation to the rigid dosing sleeve are formed stationarily, as one piece with the dosing sleeve.

19. The device as claimed in claim 16, wherein a dosing borehole is formed in the dosing sleeve.

* * * * *